US010458163B1

(12) United States Patent
Trump

(10) Patent No.: US 10,458,163 B1
(45) Date of Patent: Oct. 29, 2019

(54) HINGE BRACE FOR PAINTING DOORS

(71) Applicant: Stephen R. Trump, Centerville, UT (US)

(72) Inventor: Stephen R. Trump, Centerville, UT (US)

( * ) Notice: Subject to any disclaimer, the term of this patent is extended or adjusted under 35 U.S.C. 154(b) by 0 days.

(21) Appl. No.: 15/817,999

(22) Filed: Nov. 20, 2017

Related U.S. Application Data

(60) Provisional application No. 62/427,276, filed on Nov. 29, 2016.

(51) Int. Cl.
*E05D 5/06* (2006.01)
*E05D 5/02* (2006.01)
*B05B 13/02* (2006.01)

(52) U.S. Cl.
CPC ..... *E05D 5/06* (2013.01); *B05B 13/0285* (2013.01); *B05B 13/0292* (2013.01); *E05D 5/02* (2013.01)

(58) Field of Classification Search
CPC ..... E05D 5/06; E05D 5/062; E05D 5/065; B05B 13/0285; B05B 13/0292
USPC ..... 118/500; 296/905
See application file for complete search history.

(56) References Cited

U.S. PATENT DOCUMENTS 975,131 A * 11/1910 Hauer ..... E05D 3/12 16/371
2,372,431 A * 3/1945 Kahle ..... E05D 3/12 16/371
5,164,011 A * 11/1992 Ray ..... B05B 13/0285 118/500
5,355,559 A * 10/1994 Bowers ..... E05D 5/065 16/384
5,493,760 A * 2/1996 Takimoto ..... E05D 3/12 16/366
5,511,837 A * 4/1996 Dempsey ..... E05C 17/025 16/319
5,551,980 A * 9/1996 Turnbo ..... B05B 13/0285 118/500
5,675,865 A * 10/1997 van der Steur ..... B05B 13/0292 16/374
5,692,264 A * 12/1997 van der Steur ..... B05B 13/0292 16/374
5,846,016 A * 12/1998 Martinez ..... B05B 13/02 403/388
6,090,204 A * 7/2000 Speed ..... B05B 13/0285 118/500
6,334,236 B1 * 1/2002 Kalliomaki ..... E05D 11/1057 16/334
6,702,130 B1 * 3/2004 Carlilse ..... B05B 13/0285 118/500
6,875,277 B1 * 4/2005 Edgerton ..... B05B 13/0285 118/500

(Continued)

*Primary Examiner* — Jeffrey O'Brien
(74) *Attorney, Agent, or Firm* — Legends Law Group, PLLC; Stephen H. Bean, Esq.

(57) ABSTRACT

A hinge brace for supporting doors to be painted is provided. The brace is connected to standard door hinge hardware using either the existing door hinge pin or a disposable pin of smaller diameter. By allowing the bracing of multiple doors at the hinge, the painter can more safely and efficiently prepare and paint multiple doors in one painting session. The hinge brace of the present invention accommodates supporting two or more doors for painting and saves time by not requiring the painter to remove door hinge hardware.

4 Claims, 9 Drawing Sheets

(56) References Cited

U.S. PATENT DOCUMENTS 7,383,613 B2 * 6/2008 Yilmaz ..... B05B 13/0292 16/82
7,481,323 B2 * 1/2009 Fisher ..... B05B 13/0285 211/189
7,559,116 B2 * 7/2009 Hulbert ..... E05D 3/127 16/366
7,908,711 B2 * 3/2011 Johnson ..... A47G 25/06 16/366
8,419,000 B2 * 4/2013 St. John ..... B25B 11/00 118/500
8,707,976 B2 * 4/2014 Bauer ..... B05B 13/0285 135/96
9,816,303 B2 * 11/2017 Lee ..... E05D 5/0276
10,202,241 B2 * 2/2019 Valliere ..... B65G 1/14
2004/0034966 A1 * 2/2004 Wegman ..... E05D 5/06 16/254
2004/0231106 A1 * 11/2004 Shire ..... E05D 5/06 16/390
2005/0230578 A1 * 10/2005 Stockton ..... B05B 13/02 248/217.3
2005/0284368 A1 * 12/2005 Fogg ..... B05B 13/0285 118/500
2006/0059662 A1 * 3/2006 Roeper ..... E05D 5/06 16/382
2007/0175390 A1 * 8/2007 Allen, II ..... B05B 13/0292 118/505
2008/0127565 A1 * 6/2008 Taylor ..... E05D 5/06 49/394
2009/0256039 A1 * 10/2009 Allen, III ..... B05B 13/0285 248/222.14
2016/0076287 A1 * 3/2016 Sandoval ..... B05B 12/24 16/250
2017/0268269 A1 * 9/2017 Nicholas, III ..... E05D 5/06
2019/0194988 A1 * 6/2019 Mori ..... E05D 3/02

* cited by examiner

HINGE BRACE FOR PAINTING DOORS

FIELD OF THE INVENTION

The present invention relates to a hinge brace for supporting doors for painting. The invention is useful in the fields of residential and commercial construction as well as home remodeling and home improvement. The device is used to support multiple doors for painting at the same time, most likely with the use of a paint sprayer.

BACKGROUND OF THE INVENTION

In the construction industry, doors are generally purchased from a specialty mill with the doors pre-hung within their surrounding doorjambs. As part of the finish construction, a pre-hung door unit, which is a door and its surrounding doorjamb, is centered within a rough construction door frame and are then plumbed to square using shims. When it is time for painting, the painters remove the door from the doorjamb by pulling the door hinge pins and placing the door in a central area for painting with a paint sprayer. Thus, it is common in both home and commercial construction for painters to paint numerous doors at the same time.

There are numerous methods and devices used in the industry for supporting doors in a manner that allows for efficient painting using a paint sprayer. A very common low-tech approach is to arrange the doors in an accordion fashion by lightly nailing a connecting piece of wood between the tops of adjacent doors. Often, a painter will use paint stir sticks or similar thin scraps of lumber to connected the doors needed to be painted in a line. This requires a ladder for standing high enough to hammer down into the tops of the doors. In this manner, the painter can arrange the doors in an alternating, accordion-shaped line and then proceed down each side of the line using a paint sprayer to spray both sides of the doors as well as the hinge and latch ends of each door. The door hinges are either taped-off or removed during the painting process. If the hinges are removed before painting then there is a risk that paint buildup in the hinge area can adversely affect the door fit within the doorjambs once the painted door is reinstalled.

Door stands are commonly sold in paint supply stores for securing doors in an accordion line for painting. For example, Warner Manufacturing Company makes a door stand called Quicktruss that is a ninety-degree L-shaped metal truss with metal teeth on each end for hammering into the tops of the doors. Other companies make similar door trusses. There are two distinct disadvantages of using commercial trusses or scrap lumber to connect the tops of the doors. First, a ladder must be used to affix the door supports. This is cumbersome and also more prone to promoting injury through falls. Second, solid core doors may not be securely held with just top attachments. For example, many users of commercial door stand trusses drill their own holes in the trusses for using screws to secure heavy doors in the accordion line because the metal teeth are prone to slippage with heavier, solid doors.

In addition to simple door trusses, there are also several carousel-type devices and other complicated, expensive door holders used in the industry. The complexity and cost of these systems can be a significant disadvantage. For example, Mr. LongArm, Inc. sells a carousel-type multi-purpose door rack under the brand name Rack-n-Paint. The rack is relatively expensive and requires the painter to affix the top and bottom edges of the door to the carousel and then maintain a balanced load on the rack during use. Another example of a more expensive painting system is the Door Rack Painter found at www.doorrackpainter.com. This system utilizes racks for holding numerous doors at the same time after the doors have been painted. The system requires inserting rods into the top and bottom of the door and then turning the turning the door from one side to the other while painting and then storing the painted door in a rack fixture. For normal sized doors this system requires two people to turn the doors.

There are also several prior art patents that disclose door painting devices and fixtures. U.S. Pat. No. 5,164,011 (Ray) discloses a door painting fixture that holds a door in a vertical position for painting. The fixture requires inserting pins into the top and bottom of the door and then connecting the pins to laterally extended top and bottom horizontal arms. The door can be rotated about a vertical axis for painting. U.S. Pat. No. 5,551,980 (Turnbo) discloses a holder for supporting doors for painting or other type of treatment. The holder uses hinges that are affixed to the door and a support stand for securing the door while painting. The hinges are screwed into the door and bolted to the stand. U.S. Pat. No. 6,702,130 (Carlilse) discloses another door painting rack similar to the one disclosed by Ray. The Carlilse rack uses pins and horizontal arms to spin a door about a vertical axis. Like the Ray fixture, the Carlilse rack requires the user to physically remove the doors from the rack prior to painting additional doors. There are numerous other prior art references disclosing door painting systems. Most of these systems use some form of pin and rack system for spinning a door.

There exists a need in the art for a simple device that will allow a painter to quickly and efficiently paint multiple doors at a time. The device should be simple, cost-effective, and easy to use. The device should not require time-consuming set up and should allow for a single person to quickly paint multiple doors. The present invention provides such a device.

SUMMARY OF THE INVENTION

The present invention provides a novel hinge brace for supporting two or more doors for painting. The hinge brace provides a rigid connection between doors using the existing door hinge plates. The hinge braces of the present invention can use either the original door hinge pin or other pins of smaller diameter, such as nails or simple L-shaped pins that facilitate rapid removal of the pin after painting and also preserve the aesthetics of the original hinge pin. The invention is mechanically simple, which offers a cost-effective solution for supporting multiple doors for painting. The hinge braces of the present invention allow one person to easily prepare multiple doors for painting without requiring ladders or complicated devices for spinning doors about a vertical axis, as are currently commonly used in the art. The hinge braces disclosed herein can be formed in the shape of an elbow, for two-door arrangements, or any number of multiple-sided plates, for arranging doors in sets of three or more. Using the present invention in a 90° elbow form, it is possible to quickly arrange standard accordion rows of doors in two-door sets.

Figure 1:
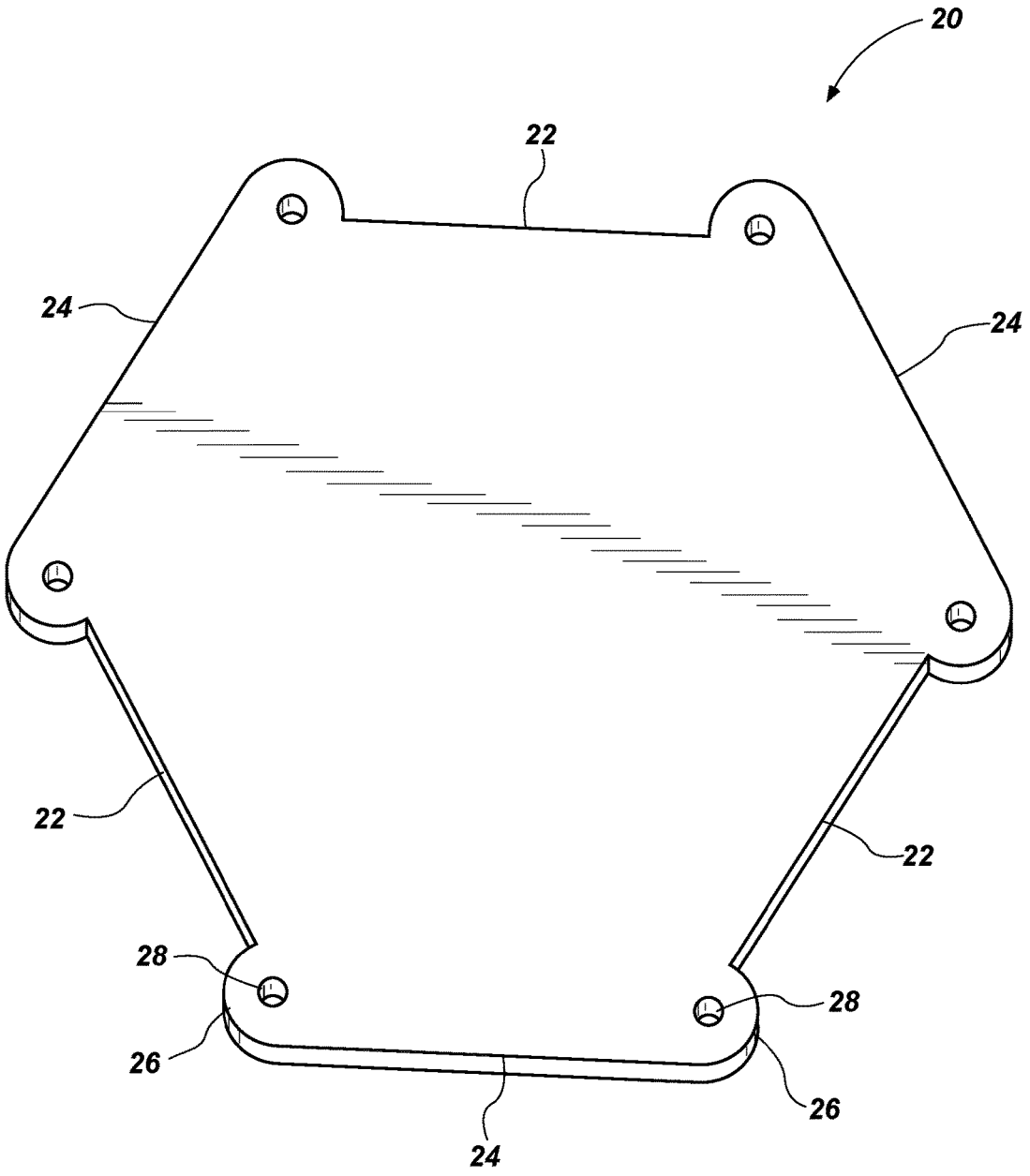
FIG. 1 illustrates a perspective view of a plate-type hinge brace of the present invention.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Reference will now be made in detail to the presently preferred embodiments of the invention. There are also representative examples of the invention illustrated in the accompanying drawings. Throughout the following detailed description, the same reference numeral refers to the same elements in all figures.

Figure 2:
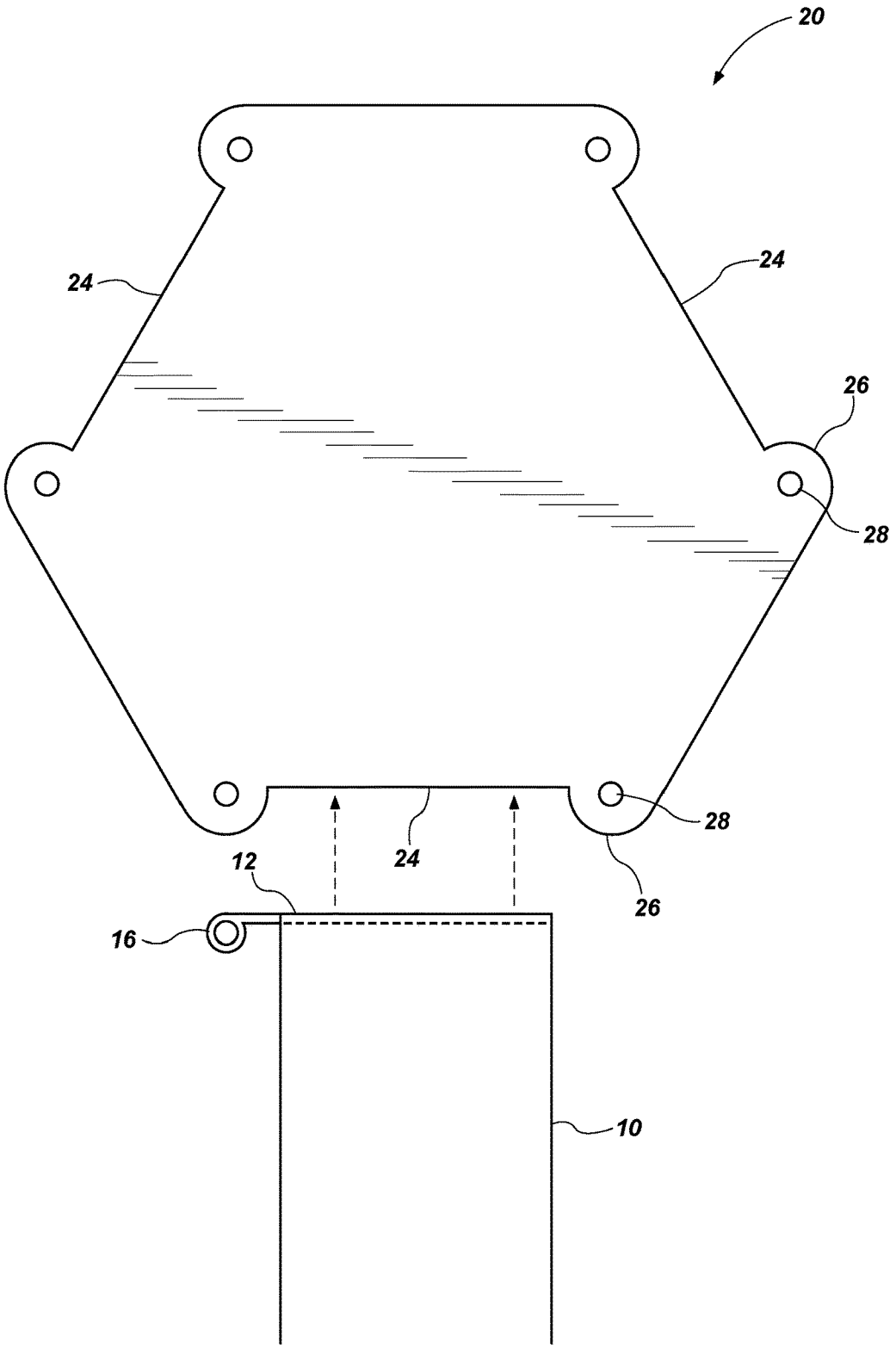
FIG. 2 illustrates a top view of a plate-type hinge brace of the present invention.
Figure 3:
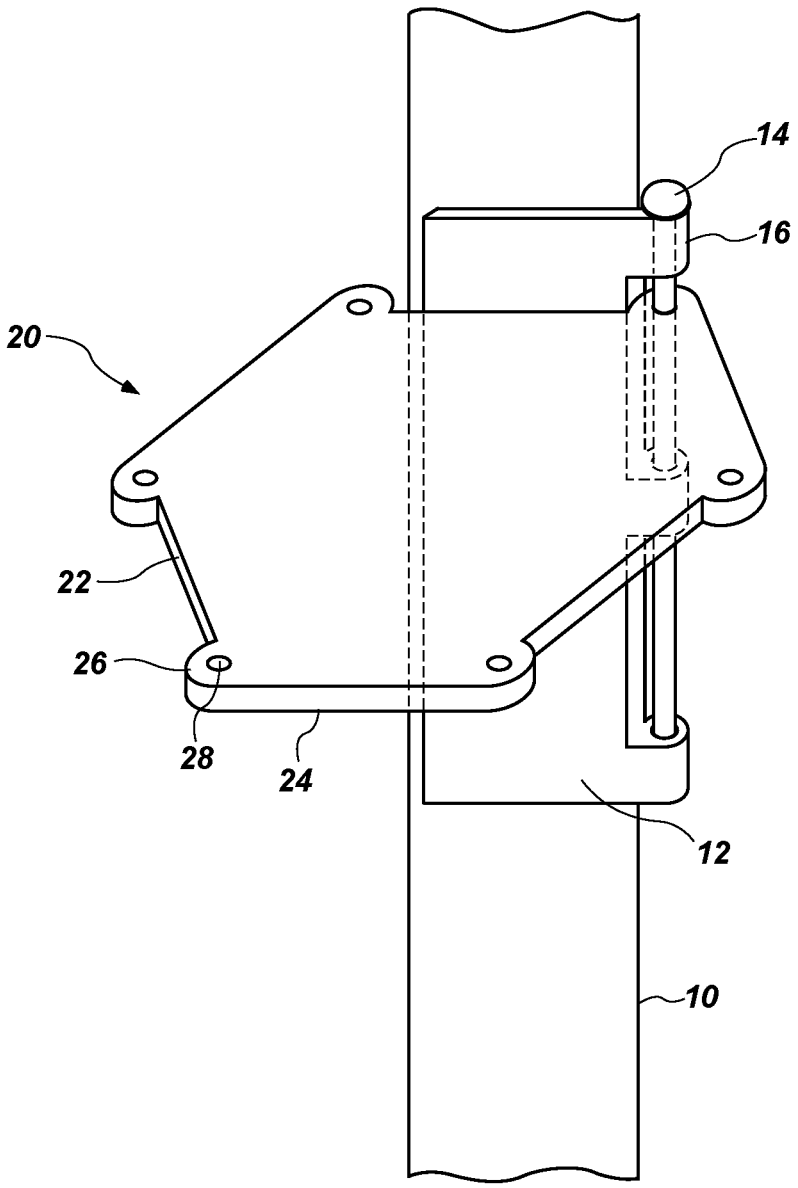
FIG. 3 illustrates a perspective view of a plate-type hinge brace of the present invention engaged with a door.

The present invention provides a hinge brace for supporting doors for painting. Referring to FIGS. 1-3, there is hinge brace plate 20 having a number of sides. The sides alternate between recessed edges 22 and offset ridges 24. In FIGS. 1-3, plate 20 is shown as a single, flat piece. However, it is within the scope of the present invention that plate 20 may also be formed such that ridges 24 are raised up from the planar surface of plate 20. The advantages of raised ridges 24 with respect to the present invention is discussed below. Plate 20 may be formed from plastic, metal, wood, or any other rigid material capable of providing bracing support for the doors to be painted. Although FIGS. 1-3 show a plate having six sides, the present invention contemplates additional configurations of braces that include more than and less than six sides. As shown in the accompanying figures, ridges 24 have bulbous ridge knuckles 26 on opposing ends of the ridges. Each ridge knuckle 26 has a hinge pin hole 28 for receiving a hinge pin from a standard door hinge.

According to the invention, ridge knuckles 26 and their hinge pin holes 28 are configured at a spatial distance from recessed edge 22 such that door 10 can be secured against recessed edge 22 and held in a fixed position relative to plate 20 by inserting a door hinge pin 14 through door hinge knuckles 16 and hinge pin hole 28. It will be appreciated that any rigid pin can be inserted through door hinge knuckles 16 and hinge pin hole 28 in lieu of using an actual door hinge pin. One advantage of using an alternative pin as opposed to door hinge pin 14 is that smaller diameter pins can be used, which may facilitate easier placement and removal of the pin through plate 20. Furthermore, by using an alternative pin the door hinge pin 14 will not be inadvertently coated in a layer paint on any length of the pin that is not enclosed within door hinge knuckles 16.

The size of plate 20 will vary depending on the number of recessed edges 22 for receiving doors 10. In one embodiment of the invention, plate 20 comprises six sides, with recessed edges 22, separated at 120°, with plate 20 measuring approximately 5" across. In another embodiment of the invention, plate 20 comprises six recessed edges 22, separated at 60°, with plate 20 measuring 24" across. It will be appreciated by one of ordinary skill in the art that any number of sides and dimensions are possible.

The advantages of the present invention over the prior art are numerous. The hinge braces of the present invention are simple and, therefore, inexpensive. Furthermore, affixing multiple doors to brace plate 20 using the actual hinge hardware installed on the doors eliminates the need to use ladders to climb up and nail or screw braces into the tops of the doors. This is a marked safety improvement. Also, by using the door hinge hardware to secure the doors to brace plate 20 of the present invention, the painter saves time by not having to uninstall and then reinstall the hinge hardware on the door. Further, the door and doorjamb spacing is not altered because hinge plates 12 are not removed from the door 10 and the underlying portion of door 10 that is exposed by removing hinge plate 12 is not covered with a layer of paint. It is a simple matter to remove door hinge pin 14 from hinge plate 12, cover hinge plate 12 with painter's tape, secure door 10 to brace plate 20 (along with at least one other door) and paint both sides of door 10. The present invention is more efficient and less expensive than prior art devices and can also be used by a single painter without the assistance of others or the need of a ladder. Also, by providing bulbous ridge knuckles 26 and hinge pin holes 28 on opposing sides of recessed edge 22, the present invention accommodates both right-hand and left-hand door hinge arrangements while maintaining the same overall distance between doors for ease of painting.

Figure 4:
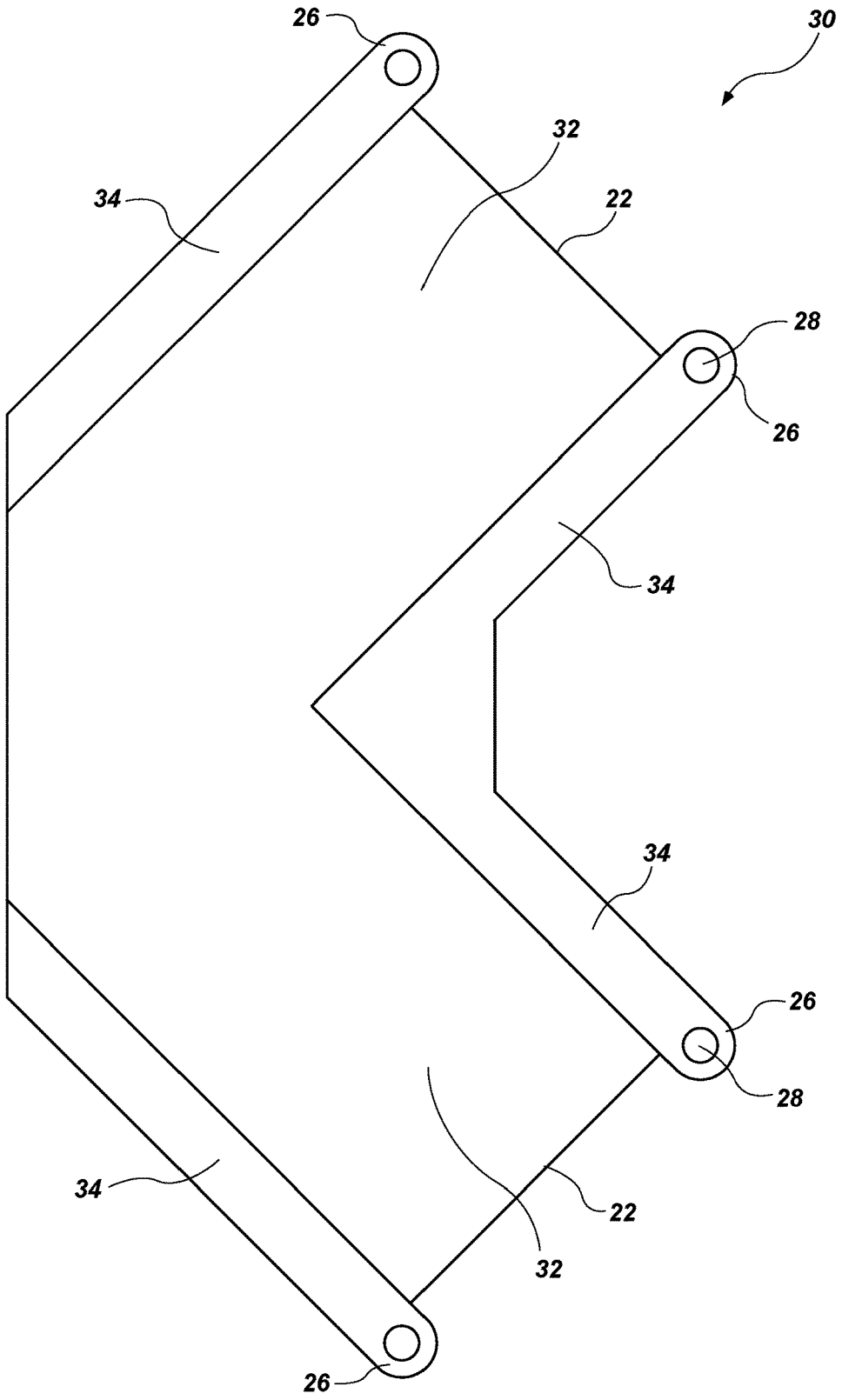
FIG. 4 illustrates a top view of an elbow-type hinge brace of the present invention.
Figure 5:
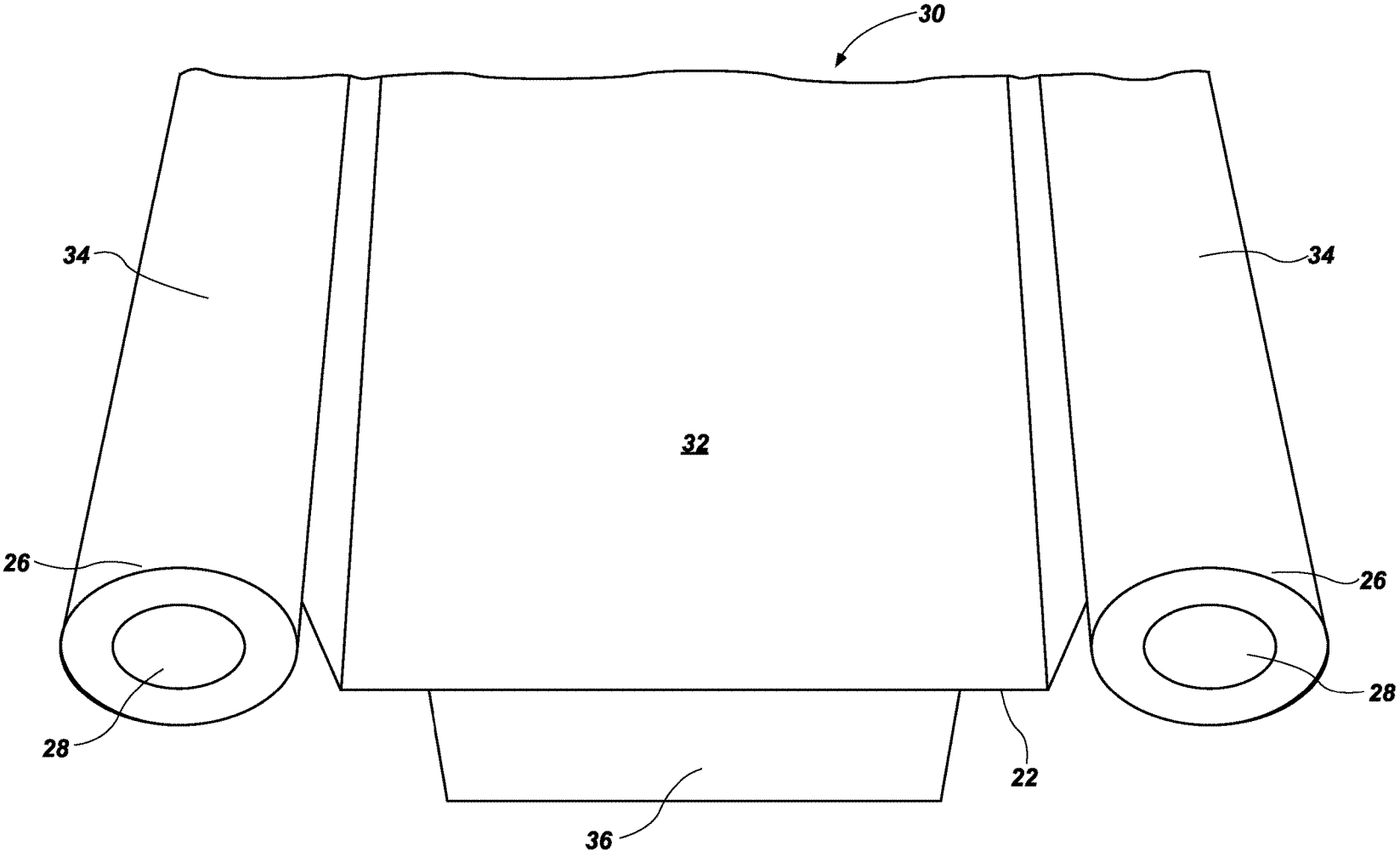
FIG. 5 illustrates a perspective view of an elbow-type hinge brace of the present invention.
Figure 6:
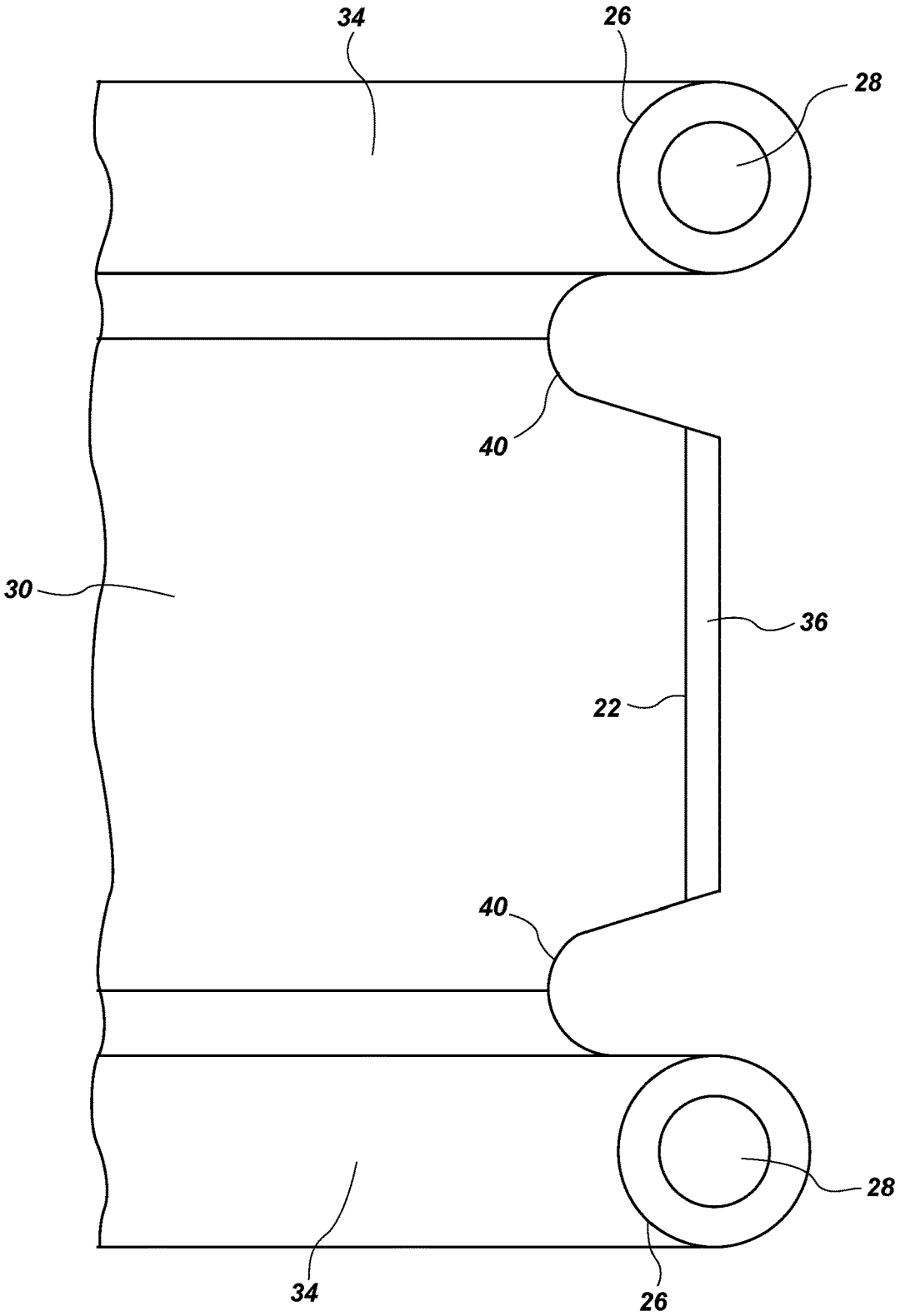
FIG. 6 illustrates a top view of an embodiment of an elbow-type hinge brace of the present invention.

Referring to FIGS. 4-6, another embodiment of the present invention is a hinge brace in the shape of an elbow. In this embodiment, hinge brace elbow 30 comprises two arms 32, with each arm configured to support a separate door 10 at door hinge plates 12. Arms 32 of elbow 30 are preferably formed at a 90° angle, although other angles are also envisioned. As with plate 20, elbow 30 is also formed from plastic, metal, wood, or any other rigid material capable of providing bracing support for the doors to be painted. At the distal end of each arm 32 is recessed edge 22 having lower bracing portion 36. The lower bracing portion 36 extends down in a vertical direction from the planar surface of arm 32 and provides additional surface area for contacting and bracing hinge plate 12 of door 10. Elbow 30 also comprises ridges 34 on opposing sides of each arm 32. There is a bulbous ridge knuckle 26 with a hinge pin hole 28 located at the distal end of each ridge 34. Hinge pin holes 28 are configured at a spatial distance from recessed edge 22 such that door 10 can be secured against recessed edge 22 and lower bracing portion 36 and held in a fixed position relative to elbow 30 by inserting a door hinge pin 14 through door hinge knuckles 16 and hinge pin hole 28.

Raised ridges 34 in elbow 30 have the effect of lowering recessed edge 22 and lower bracing portion 36 relative to door hinge plate 12 such that the brace can be placed on top of the highest hinge knuckle 16 without leaving an unpainted line on the hinge edge of door 10 above the top hinge knuckle. Thus, raised ridges 34 accommodate rapid deployment of elbow 30 or plate 20 in multiple door sets by placing the brace directly over the top hinge knuckle 16 of the doors 10 and quickly securing doors 10 to the brace. FIG. 6 depicts an additional modification of the present invention to further reduce the chance of leaving unpainted lines across the hinge edge of door 10. The modification is accomplished by forming a notch 40 extending from bulbous ridge knuckle 26 to recessed edge 22. The notch allows for fine paint particulates from a paint sprayer to more fully cover the areas of door 10 both below and above the hinge brace.

Figure 7:
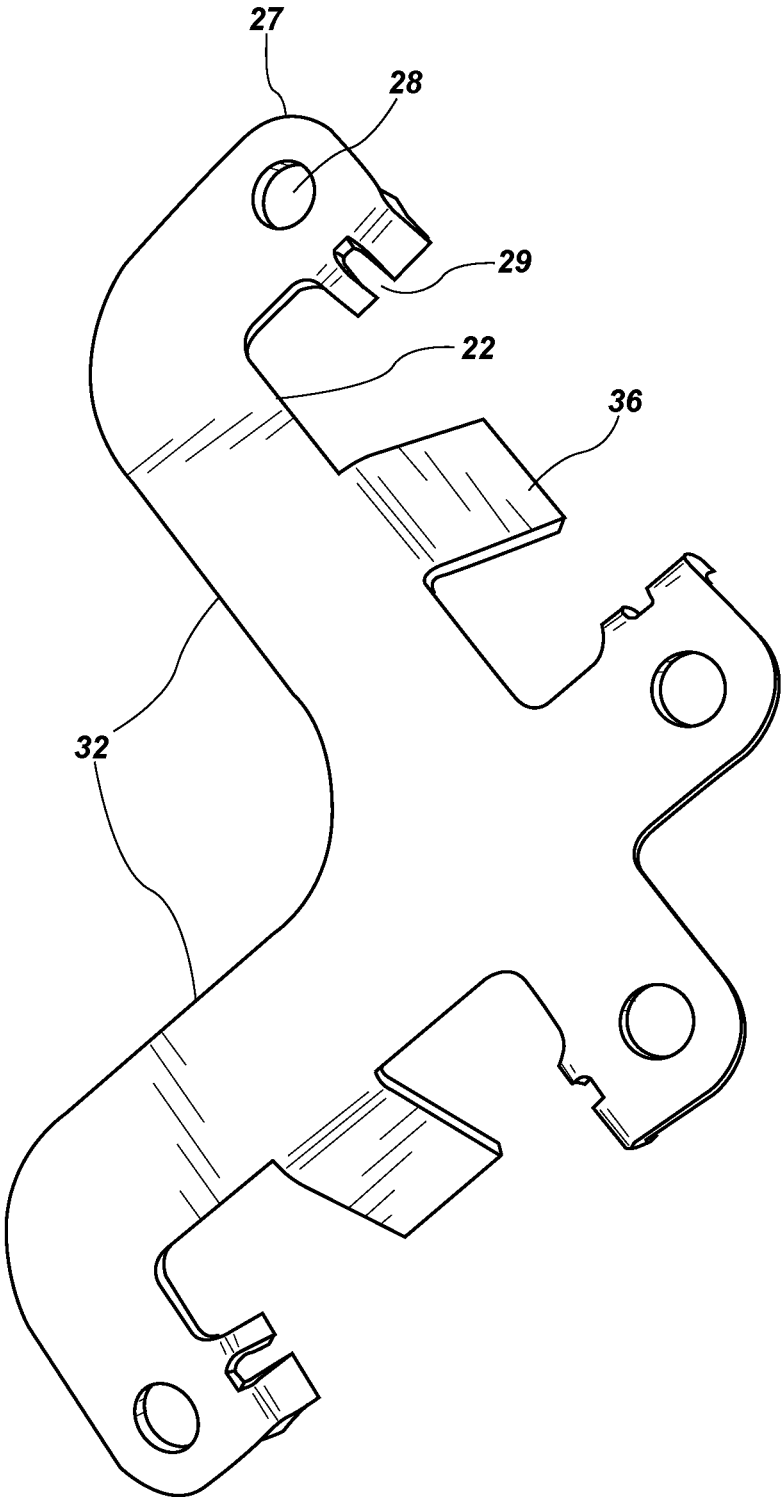
FIG. 7 illustrates a top perspective view of an embodiment of an elbow-type hinge brace of the present invention.
Figure 8:
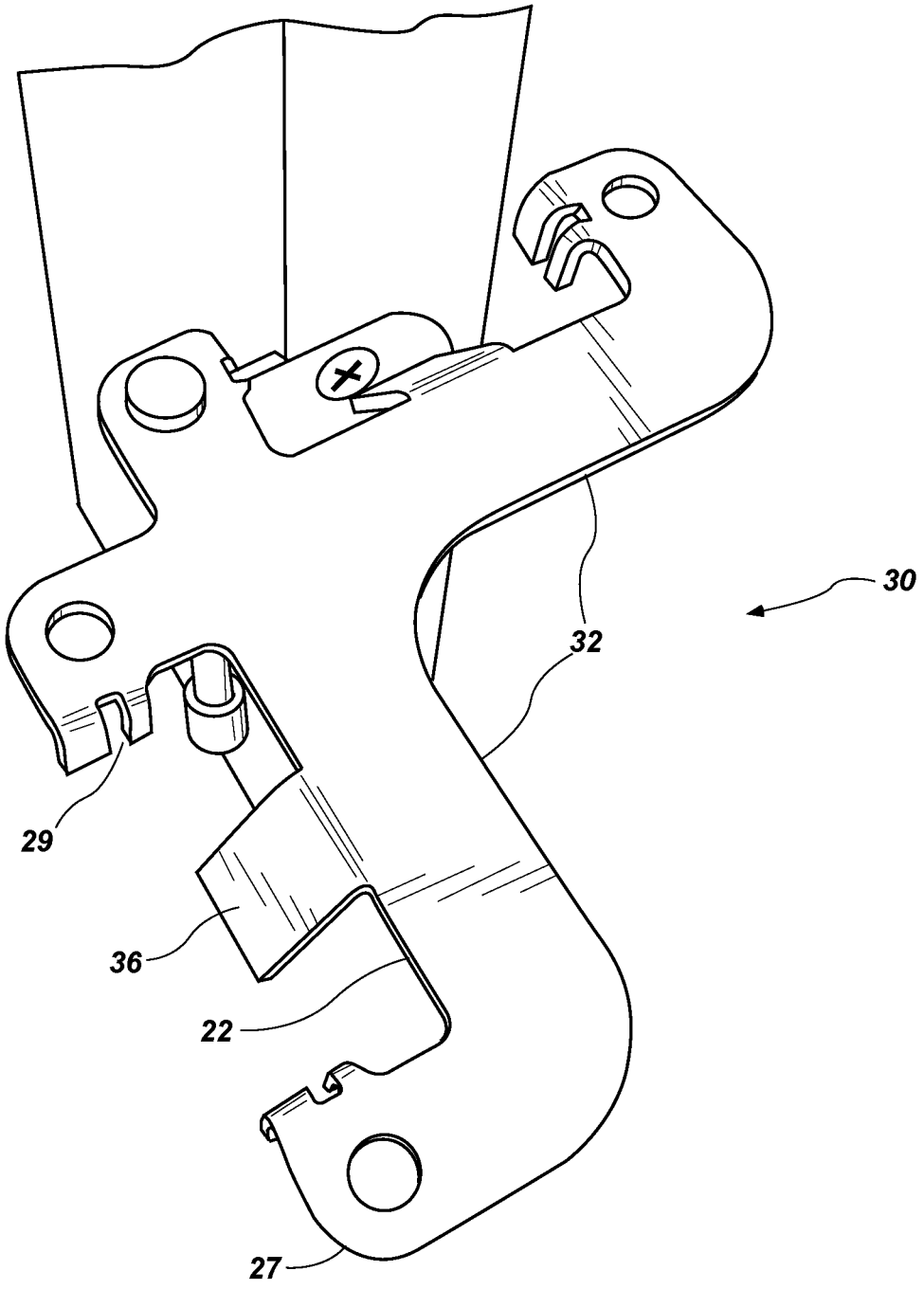
FIG. 8 illustrates a top perspective view of an embodiment of an elbow-type hinge brace of the present invention with the hinge brace attached to a door hinge.
Figure 9:
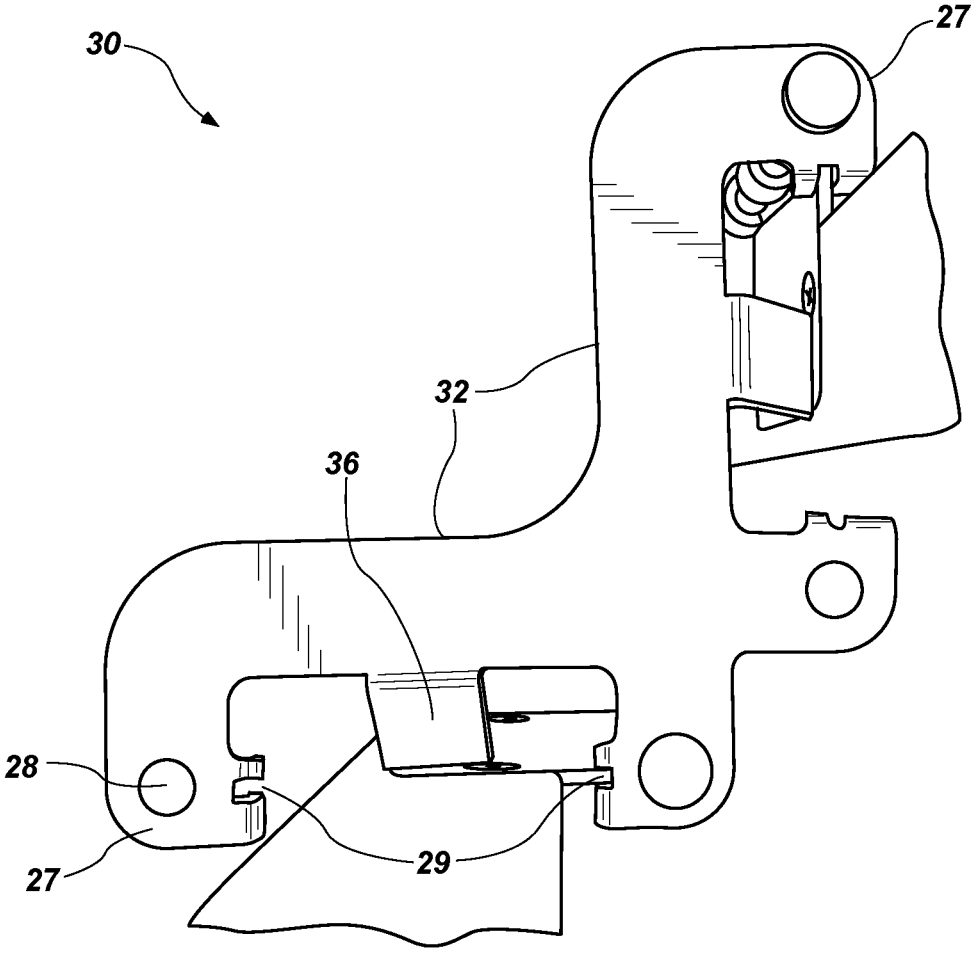
FIG. 9 illustrates a top view of an embodiment of an elbow-type hinge brace of the present invention with the hinge brace attached to a door hinge on two separate doors.

Referring to FIGS. 7-9, there is shown another embodiment of the present invention. This embodiment is an elbow-shaped hinge brace with hinge plate slots. In this embodiment, elbow 30 comprises two arms 32 oriented approximately 90° from each other. It will be appreciated that additional arms with varying degrees of separation are also contemplated in the present invention. Arms 32 are substantially planar with respect to each other. At the end of each arm 32 is a pair of knuckles 27 that comprise hinge pin holes 28 and hinge plate slots 29. Hinge plate slots 29 are formed in a downward fold of knuckle 27, with the slot aligned in an offset fashion such that the slot braces against hinge plate 12 when hinge pin 14 is inserted through hinge pin hole 28. Lower hinge brace 36 is formed on arm 32 along a portion of recessed edge 22 between knuckles 27 and is bent in an angled fashion to provide an orthogonal bracing force as to the bracing action of hinge plate slot 29 against hinge plate 12 when hinge pin 14 is inserted into hinge pin holes 28. It is further contemplated that elbow 30 may comprise a single knuckle 27 at the end of each arm instead of knuckle pairs. The advantage of single knuckles is lower manufacturing costs. However, the advantage of knuckle pairs is that hinge brace elbow 30 could be used with both left and right-sided doors at the same time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A hinge brace comprising an elbow having two arms, each arm having a knuckle, a hinge pin hole formed in said knuckle, a recessed edge, and a tab extending from each recessed edge, wherein each tab further comprises a distal tab edge extending from said recessed edge and said tab is angled such that each distal tab edge braces against a door hinge when a pin from said door hinge is inserted through said hinge pin hole of said knuckle.

2. The hinge brace of claim 1, further comprising a hinge plate slot formed in a downward fold of said knuckle, wherein said hinge plate slot braces against an edge of said door hinge when said pin from said door hinge is inserted through said hinge pin hole of said knuckle.

3. The hinge brace of claim 1, wherein each arm comprises a second hinge pin hole formed in a second knuckle located on opposite ends of each arm.

4. The hinge brace of claim 3, further comprising a hinge plate slot formed in a downward fold of each knuckle, wherein at least one of said hinge plate slots brace against an edge of said door hinge when said pin from said door hinge is inserted through a corresponding one of said hinge pin holes of said knuckles.

* * * * *